US007445027B2

(12) United States Patent
Flachsbart et al.

(10) Patent No.: US 7,445,027 B2
(45) Date of Patent: Nov. 4, 2008

(54) MULTILAYER MICROFLUIDIC-NANOFLUIDIC DEVICE

(75) Inventors: Bruce R. Flachsbart, Champaign, IL (US); Mark A. Shannon, Champaign, IL (US); Paul W. Bohn, Champaign, IL (US); Jonathan V Sweedler, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 298 days.

(21) Appl. No.: 11/375,525

(22) Filed: Mar. 14, 2006

(65) Prior Publication Data

US 2007/0217957 A1 Sep. 20, 2007

(51) Int. Cl.
*F15C 1/00* (2006.01)
*F15C 1/04* (2006.01)

(52) U.S. Cl. ..... 137/803; 137/828; 137/833

(58) Field of Classification Search ..... None
See application file for complete search history.

(56) References Cited

U.S. PATENT DOCUMENTS 6,167,910 B1 * 1/2001 Chow ..... 137/827
6,499,499 B2 * 12/2002 Dantsker et al. ..... 137/1
6,981,522 B2 * 1/2006 O'Connor et al. ..... 137/803
7,220,345 B2 5/2007 Bohn et al.

OTHER PUBLICATIONS

Kuo et al., "Manipulating Molecular Transport through Nanoporous Membranes by Control of Electrokinetic Flow: Effect of Surface Charge Density and Debye Length," *Langmuir*, pp. 6298-6303, 2001.
Liu et al., "Passive Mixing in a Three-Dimensional Serpentine Microchannel," Journal of Microelectromechanical Systems, vol. 9, No. 2, 2000.
Gray et al., "Novel interconnection technologies for integrated microfluidic systems," Sensors and Actuators, 77, pp. 57-65, 1999.
Kugelmass et al., "Fabrication and Characterization of Three-Dimensional Microfluidic Arrays," Proc. of SPIE, 3877, pp. 88-94, 1999.
Jo et al., "Three-Dimensional Micro-Channel Fabrication in Polydimethylsiloxane (PDMS) Elastomer," Journal of Microelectromechanical Systems, vol. 9, No. 1, pp. 76-81, 2000.
Anderson et al., "Fabrication of Topologically Comples Three-Dimensional Microfluidic Systems in PDMS by Rapid Prototyping," Analytical Chemistry, vol. 72, No. 14, pp. 3158-3164, 2000.

(Continued)

*Primary Examiner*—Duy-Vu N Deo
(74) *Attorney, Agent, or Firm*—Evan Law Group LLC

(57) ABSTRACT

A method of bonding layers to form a structure, comprises curing a first adhesive while squeezing a first layer and a multilayer structure together between a first backing and a second backing. The multilayer structure comprises a substrate and a second layer, and the first adhesive is between and in contact with the first layer and the second layer. Furthermore, the first layer and the second layer each have a thickness of at most 100 μm, and at least one of the first backing and the second backing comprises a first elastic polymer.

28 Claims, 3 Drawing Sheets

OTHER PUBLICATIONS

Weigl et al., "Design and Rapid Prototyping of Thin-Film Laminate-Based Microfluidic Devices," Biomedical Microdevices, 3:4, pp. 267-274, 2001.

McDonald et al., "Prototyping of Microfluidic Devices in Poly(dimethylsiloxane) Using Solid-Object Printing," Analytical Chemistry, vol. 74, No. 7, 1537-1545, 2002.

Thorsen et al., "Microfluidic Large-Scale Integration," Science, 298, 580, pp. 580-584, 6 pages, 2000.

Agirregabiria et al., "Fabrication of SU-8 multilayer microstructures based on successive CMOS compatible adhesive bonding and releasing steps," *Lab on A Chip*, 5, pp. 545-552, 2005.

Mijatovic et al., "Technologies for nanofluidic systems: *top-down* vs. *bottom-up* —a review," Lab Chip, 5, 492-500, 2005.

Chatterjee et al., "Modeling and simulation of ionic currents in three-dimensional microfluidic devices with nanofluidic interconnects," Journal of Nanoparticle Research, 7, pp. 507-516, 2005.

Yaroshchuk et al., "Electrochemical and Other Transport Properties of Nanoporous Track-Etched Membranes Studied by the Current Switch-Off Technique," Langmuir, 21, pp. 6872-6882, 2005.

Plecis et al., "Ionic Transport Phenomena in Nanofluidics: Experimental and Theoretical Study of the Exclusion-Enrichment Effect on a Chip," Nano Letters, vol. 5, No. 6, pp. 1147-1155, 2005.

Karnik et al., "Electrostatic Control of Ions and Molecules in Nanofluidic Transistors," Nano Letters, vol. 5, No. 5, pp. 943-948, 2005.

Kuo et al., 6"Hybrid three-dimensional nanofluidic/microfluidic devices using molecular gates," Sensors and Actuators, 102, pp. 223-233, 2003.

Cannon et al., "Nanocapillary Array Interconnects for Gated Analyte Injections and Electrophoretic Separations in Multilayer Microfluidic Architectures," Analytical Chemistry, vol. 75, No. 10, pp. 2224-2230, 2003.

Kuo et al., "Nanocapillary Arrays Effect Mixing and Reaction in Multilayer Fluidic Structires," Angew. Chem. Int. Ed., 43, pp. 1862-1865, 2004.

Tulock et al., "Microfluidic Separation and Gateable Fraction Collection for Mass-Limited Samples," Analytical Chemistry, vol. 76, No. 21, pp. 6419-6425, 2004.

Kuo et al., "Gateable Nanofluidic Interconnects for Multilayered Microfluidic Separation Systems," Analytical Chemistry, vol. 5, No. 8, pp. 1861-1867, 2003.

Selby et al., "Sub-micrometer solid-state adhesive bonding with aromatic thermosetting copolyesters for the assembly of polyimide membranes in silicon-based devices," Journal of Micromechanics and Microengineering, 11, pp. 672-685, 2001.

Dubois et al., "Synthesis, Structures, And Properties of Model Organic Surfaces," Annu. Rev. Phys. Chem., 43, pp. 437-463, 1992.

Loo et al., "Additive, nanoscale patterning of metal films with a stamp and a surface chemistry mediated transfer process: Applications in plastic electronics," Applied Physics Letters, vol. 81, No. 3, pp. 562-564, 2002.

Schmid et al., "Preparation of Metallic Films on Elastomeric Stamps and Their Application for Contact Processing and Contact Printing," Advances Functional Materials, 13, No. 2, 145-153, 2003.

Wang et al., "Patterning Polymers by Micro-Fluid-Contact Printing," Advanced Materials, 13, No. 17, pp. 1312-1317, 2001.

Oberhammer et al., "BCB Contact Printing for Patterened Adhesive Full-Wafer Bonded 0-Level Packages," Journal of Microelectromechanical Systems, vol. 14, No. 2, pp. 419-425, 2005.

Xia et al., "Soft Lithography," Angew. Chem. Int. Ed., 37, pp. 550-575, 1998.

Huang et al., "A method for UV-bonding in the fabrication of glass electrophoretic microchips," Electrophoresis, 22, pp. 3924-3929, 2001.

Huang et al., "Current-Monitoring Method for Measuring the Electroosmotic Flow Rate in Capillary Zone Electrophoresis," Anal. Chem., 60, pp. 1837-1838, 1988.

Kirby et al., "Zeta potential of microfluidic substrates: 2. Data for Polymers," Electrophoresis, 25, pp. 203-213, 2004.

Chen et al., "Fabrication and characterization of poly(methyl methacrylate) microchemicals bu in situ polymerization with a novel metal template," Electrophoresis, 24, pp. 3246-3252, 2003.

Flaschbart et al., "Design and fabrication of a multilayered polymer microfluidic chip with nanofluidic interconnects via adhesive contact printing," Lab Chip, 6, 667-664, 2006.

Kumar et al., "Features of gold having micrometer to centimeter dimensions can be formed through a combination of stamping with an elastomeric stamp and an alkanethiol "ink" followed by chemical etching," Appl. Phys. Lett., 63, 14, pp. 2002-2004, 1993.

* cited by examiner

Figure 3
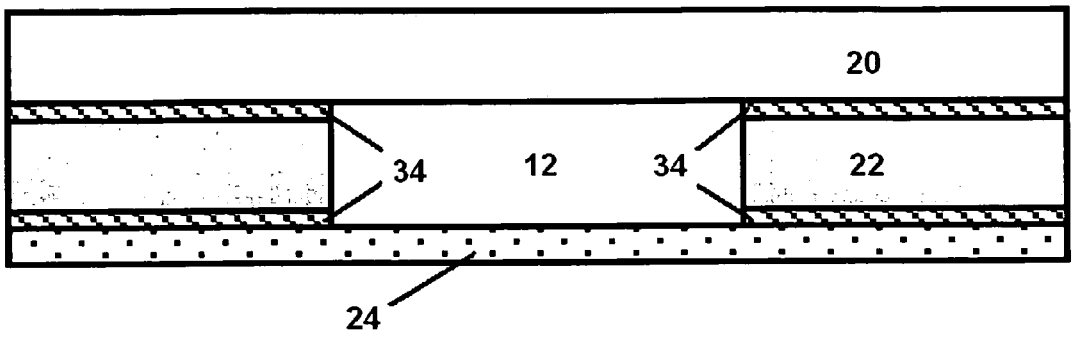
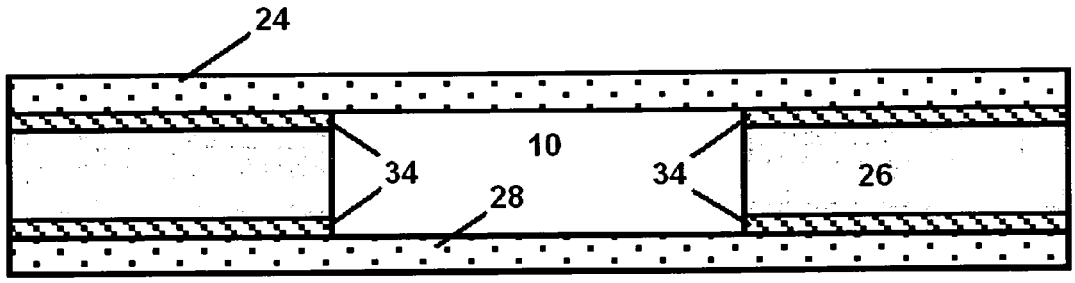
Figure 4

MULTILAYER MICROFLUIDIC-NANOFLUIDIC DEVICE

FEDERALLY SPONSORED RESEARCH OR DEVELOPMENT

The subject matter of this application may have been funded in part under the following research grants and contracts: Contract Numbers DMI-032-28162 and CTS-0120978 awarded by the National Science Foundation. The U.S. Government may have certain rights in this invention.

BACKGROUND

A number of multilayer microfluidic devices capable of performing electrophoretic separations and fluidic manipulations (mixing, reacting, piping and valving) have been demonstrated.[1] To add functionality, hybrid microfluidic-nanofluidic devices are being developed that exploit the physical dimensions of nanoscale pores in nanocapillary membranes to allow a unique set of transport capabilities.[2] In particular, a number of reports detail the use of crossed microchannels made in poly(dimethylsiloxane) (PDMS) that are vertically separated by a thin membrane containing a large array of nanocapillaries[3] that permits a variety of sample manipulations, including: nanofluidic gated injection of analytes and electrophoretic separation,[4] the mixing and reaction of two fluid streams,[5] the collection of a specific electrophoretically separated band,[6] and the separation of a sample based on mass (or molecular size).[7]

Recently, there have been important advances in polymeric microfabrication. One advance is a modified transfer process,[8] where each layer is processed as if it were an independent rigid substrate, which is then transferred, aligned, and bonded to a chip. The layer is then subsequently released from the carrier. Another advance is contact printing of an adhesive using elastomeric stamps. While elastomeric stamps have been used to contact print monolayer inks,[9] thin metal films,[10] and liquid polymers,[11] the use of contact printing in microelectromechanical (MEMS) device fabrication to pattern layers as thick as 1 μm, as in the adhesive layer printing of benzocyclobutene for wafer level bonding,[12] is relatively recent. PDMS stamps are widely used for contact printing due to their ability to conform to the surface to be printed upon, as well as their ability to be "rolled" onto that surface without trapping bubbles and particles at the interface.[13] Typically the surface of the PDMS needs to be modified so that it wets and then transfers the compound being printed.

SUMMARY

In a first aspect, the present invention is a method of bonding layers to form a structure, comprising curing a first adhesive while squeezing a first layer and a multilayer structure together between a first backing and a second backing. The multilayer structure comprises a substrate and a second layer, and the first adhesive is between and in contact with the first layer and the second layer. Furthermore, the first layer and the second layer each have a thickness of at most 100 μm, and at least one of the first backing and the second backing comprises a first elastic polymer.

In a second aspect, the present invention is a method of forming a multilayer device, comprising curing a first adhesive and a second adhesive while squeezing a first layer between a third layer and a multilayer structure; and curing a third adhesive and a fourth adhesive while squeezing a fourth layer between the third layer and a fifth layer. The multilayer structure comprises a substrate and a second layer. The squeezing of the first layer comprises squeezing the first layer, the second layer and the third layer between a first backing and a second backing, and the squeezing of the fourth layer comprises squeezing the third layer, the fourth layer and the fifth layer between a third backing and a fourth backing. The first adhesive is between and in contact with the first layer and the second layer, the second adhesive is between and in contact with the first layer and the third layer, the third adhesive is between and in contact with the fourth layer and the third layer, and the fourth adhesive is between and in contact with the fourth layer and the fifth layer. Each adhesive has a thickness of at most 2 μm, each layer has a thickness of at most 100 μm, at least one of the first backing and the second backing comprises a first elastic polymer, and at least one of the third backing and the fourth backing comprises a third elastic polymer.

In a third aspect, the present invention is a multilayer device, comprising a substrate layer, a first channel layer having a channel on the substrate, a first membrane layer having pores with an average diameter of 1 nm to 1 μm on the first channel layer, a second channel layer having a channel on the first membrane layer, and a second membrane layer having pores with an average diameter of 1 nm to 1 μm on the second channel layer. Also present are a third channel layer having a channel on the second membrane layer, a cap layer on the third channel layer, and cured adhesive between adjacent layers having a thickness of at most 2 μm. Each channel layer and each membrane layer has a thickness of at most 100 μm, and the device has a layer bond strength of at least 0.1 MPa.

BRIEF DESCRIPTION OF THE DRAWINGS

FIG. 3 is a cross-sectional view of the microfluidic channel of the third layer of the multilayer device of FIG. 2.

FIG. 4 is a cross-sectional view of the microfluidic channel of the fifth layer of the multilayer device of FIG. 2.

DETAILED DESCRIPTION

A goal of this work has been to develop a microanalytical chip, which integrates nanocapillary array membranes (NCAMs) into a multilayer structure that is scalable and can incorporate multiple analytical operations on-chip, along with the ability to move analytes sequentially through these manipulations. Moreover, the chip should be optically interrogated using ultraviolet to visible laser induced fluorescence detection, have stable electroosmotic flow (EOF) coefficients, allow for separations without excessive band spreading, and be robust with respect to electrical and mechanical properties. In order to accomplish these design goals, a fabrication method is needed that is scalable to large platform areas, since microfluidic separation often span 10 to 100 mm in length. Additionally, the platform needs to be robust in mechanical strength, reproducible in form and operation, and capable of being produced in high yields.

The present invention makes use of the discovery that a rigid-compliant method of transfer bonding, which is described here for the first time, together with a modified transfer process, and contact printing of an adhesive using elastic polymer stamps, allows for the fabrication of a multilayer microfluidic device. This device can be used for electrophorectic separations and other analytical manipulations. The fabrication scheme produces high quality devices that can incorporate as many fluidic layers as needed. These devices allow greatly improved nanofluidic to microfluidic interfacing, especially as each layer may be selected for a particular task. The ability to stack layers and incorporate multiple capillary arrays into a single device opens up a range of complex operations and architectures that can be selected for applications ranging from sample cleanup and preparation to multistage separations and sample collection.

Figure 1:
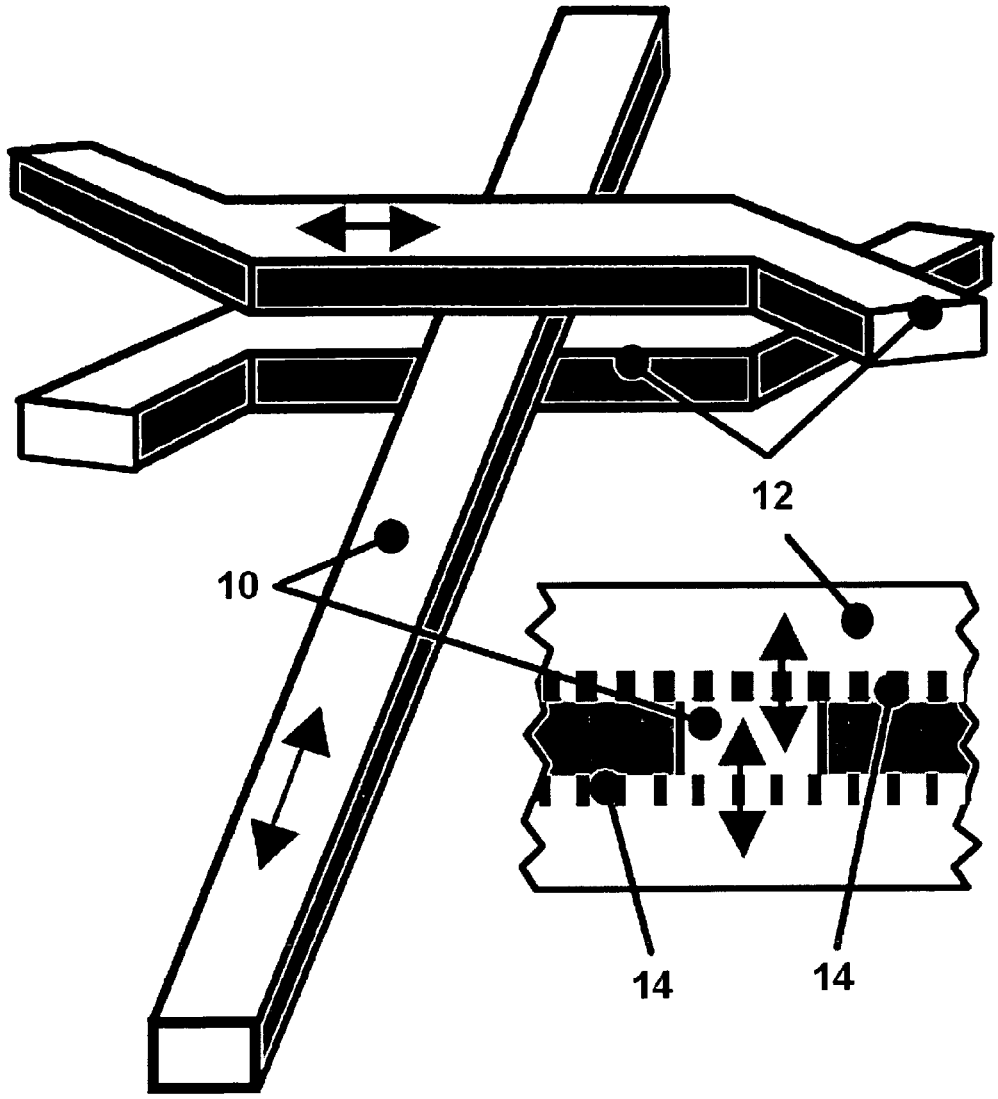
FIG. 1 illustrates a portion of a multilayer device, showing three microfluid channel layers separated vertically by two nanocapillary array membranes.

The approach to designing the multilayer device or chip is to fabricate microfluidic channels in layers that are separated by porous membranes. FIG. 1 shows two membranes (14 and 14) with different pore sizes (for example, 10 and 220 nm, or 10 and 100 nm) separating three channel layers (12, 10 and 12). Where the channels cross over each other, flow occurs across the membrane when a potential difference is applied to the different microfluidic channel layers. In this example, there are two sets of cross-channel interconnects at both ends of the chip for the purpose of injecting samples into and collecting samples from the long separation channel (10) located in the center layer. The fluid and potentials are introduced to the chip through the large reservoirs at the ends of the chip.

Figure 2:
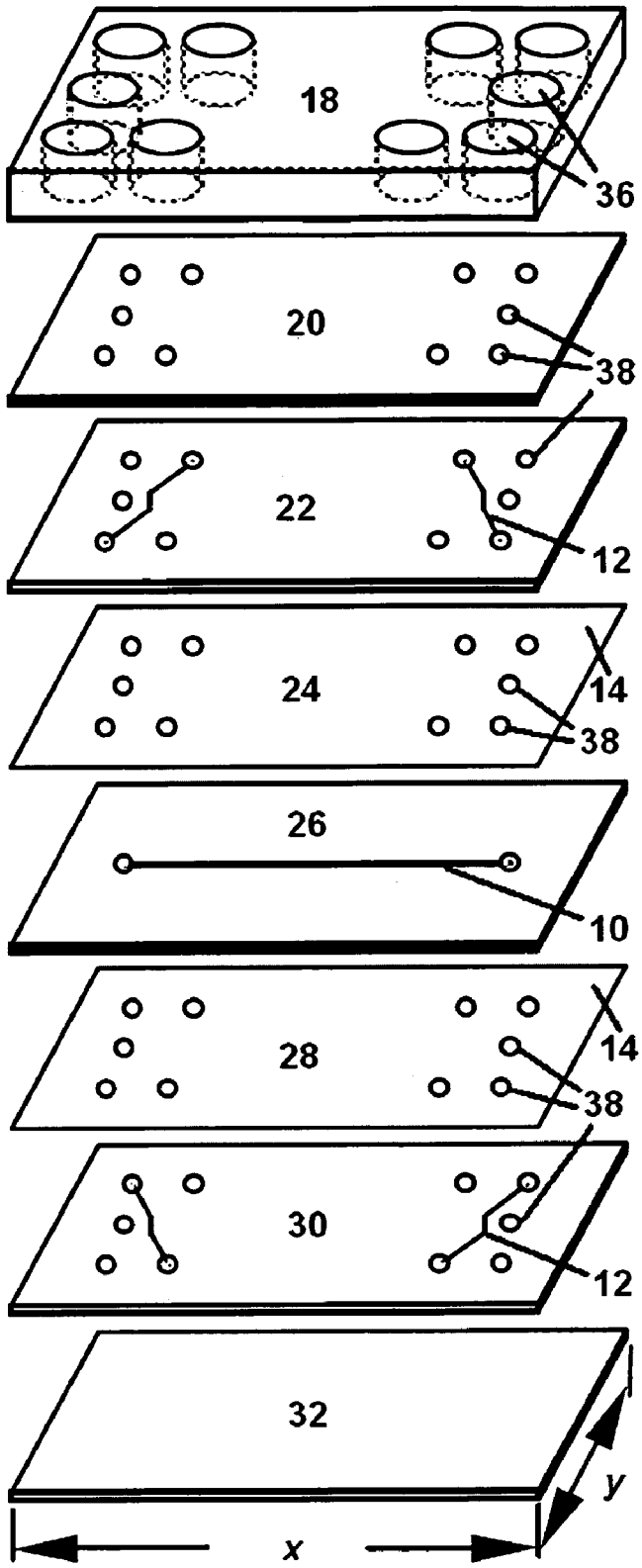
FIG. 2 is a diagram depicting individual layers in an 8-layer multilayer device.

FIG. 2 shows a design for each layer in the chip. Layer #1 (18) is a substrate, with reservoirs (36). Layer #2 (20) is a via reduction layer, to couple vias define channels (12) for sample introduction or collection. Layer #4 (24) and Layer #6 (28) are membrane layers, and are preferably made of nanocapillary array membranes (14). Layer #5 (26) is a separation channel layer, which defines a separation channel (10). Layer #8 (32) is a cap layer. Adhesive, not illustrated, is printed on the top and bottom surfaces of Layers #3, #5 and #7, and only on the top surface of Layer #2, during assembly.

The different levels of channels allows injection of reagents, such as buffer and sample fluids, into the separation channel (10) from the reservoirs (36), through the channel (12) in Layer #3, and then the bands produced by the separation are collected in the channel (12) in Layer #7 for analysis (for example, by spectroscopy). The cap layer (32) is preferably thin enough so that a high numerical aperture (N.A.>1) microscope objective may be used to resolve the bands collected. By having multiple levels and channels, the process of injection and collection can occur multiple times across multiple membrane interconnects. While the chips illustrated have only two interconnect regions (Layers #4 and #6) and three microfluidic levels (Layers #3, #5 and #7), any number of additional layers may be added. Further details of operation are described in "HYBRID MICROFLUIDIC AND NANOFLUIDIC SYSTEM" to Paul W. Bohn et al., Published Patent Application, publication no.: US 2003-0136679, published 24 Jul. 2003, the entire contents of which are hereby incorporated by reference, except where inconsistent with the present application.

FIGS. 3 and 4 show cross-sectional views of channels at different layers. Illustrated in FIG. 3, Layer #3 (22) defines a channel, 12, and is attached to Layer #2 (20) and Layer #4 (24) by adhesive, 34. Illustrated in FIG. 4, Layer #5 (26) defines a separation channel, 10, and is attached to Layer #4 (24) and Layer #6 (28) by adhesive, 34. The adhesive is at most 2 μm thick, preferably at most 1.5 μm thick, more preferably at most 1 μm.

The layers of the chip may be formed from any material of the desired thickness that may be patterned, for example silicon, glass, metals, alloys and polymers. Preferably, the layers are formed of at least one polymer, for example poly (methylmethacrylate) (PMMA) and polycarbonate (PC), as well as photoresist polymers used in semiconductor device fabrication. Preferably, each layer is at least 1 μm thick, such as 1-100 μm, more preferably 5-60 μm thick, including 6-40 μm thick and 6-10 μm thick. The length and width of the layers (x and y in FIG. 2) are selected so that the device may accommodate the length and orientation of the channel desired for the device, and for convenience of handling the device, for example x may be 40 mm and y may be 24 mm.

The overall fabrication scheme of the multilayer device begins with a substrate on which the device is build. Each layer is individually formed on a carrier plate, including if necessary: spinning and curing the layer; patterning the layer; etching the layer; and contact printing the adhesive. Once formed, the layer is transferred, aligned, and bonded on the substrate, and then released from the carrier plate. The process is repeated for each subsequent layer, to form a multilayer stack.

Initially, adhesive is contact printed on the top surface of the via reduction layer (Layer #2), and then the layer is bonded to the substrate. After bonding the layer to the substrate, the carrier plate is released. The next layer, a channel layer (Layer #3) is bonded to the device stack in the same way as the previous layer. Next, the bottom surface of Layer #3 and the top surface of the separation channel layer (Layer #5) are coated with adhesive. A membrane layer (Layer #4) is placed between them, aligned and bonded together. After the bonding process, the carrier plate for Layer #5 is released. The process is repeated for the second membrane layer (Layer #6) and the other channel layer (Layer #7). The final, unpatterned cap layer (Layer #8) is then bonded to the device after printing the bottom of Layer #7 with adhesive. When completed, the device is heated to given a final cure to the adhesive.

The first and topmost layer serves as the substrate for the device. The substrate is preferably rigid, drilled with holes that serve as the reservoirs. For example, the substrate may be PC approximately 1.5 mm thick, having ten 4 mm diameter reservoirs.

The first two layers on top of the substrate, and alternating layers thereafter, are individual layers made to form and seal the channels within the chip. The layers are formed, for example, by spincoating PMMA dissolved in propylene glycol monomethyl ether acetate (PGMEA) and anisole onto a coverglass, which acts as the carrier plate for the layer, and then the polymer is cured at 180° C. for 6 to 24 hours, depending on layer thickness. After curing, the layer is patterned to form any required channels and/or vias. To form the patterns, a patterned mask is formed on the layer, for example a layer of aluminum about 100 nm thick sputter coated onto the layer and patterned using standard photolithographic procedures; development of a positive photoresist etches the aluminum layer, transferring the mask pattern to the aluminum. The areas not protected by the patterned mask may be removed by etching, such as reactive ion etching (RIE). A straight profile for the channels, such as that created by RIE, is important for the operation of the device. Finally, the aluminum layer is removed, for example with photoresist developer, which also removes any remaining photoresist residue. As used herein, the term "to cure" or "curing" means any chemical or physical change, other than solely loss of solvent by evaporation, which increases the glass transition temperature ($T_g$) of the adhesive, for example heating to cause cross-linking of the adhesive.

The membrane layers, Layer #4 and Layer #6, may be made of any porous material, preferably having pores with an average diameter of 1 nm to 1 μm, such as commercially available NCAMs having a thickness of 6-10 μm. For example, nanocapillary PC membranes, which are nuclear track etched to produce nanometer scale diameter cylindrical pores through the membrane, may be used. The membranes are coated with polyvinylpyrrolidone (PVP) to make the layers hydrophilic, since PC is naturally hydrophobic and without the PVP coating filling both the microfluidic channels and pores (nanocapillaries) would be difficult. These membranes can be obtained with nominal pore diameters ranging from 10 nm to 400 nm. The vias may be formed by etching, for example with oxygen etching using a silicon shadow mask (the vias are millimeters in size and resolution issues are not significant).

The cap layer, Layer #8, is preferably 5-10 μm thick, to allow for spectroscopic analysis of fluid in the channel for example of the bands produced in the separation channel.

The adhesive is applied to the layers by contact printing, first by coating a temporary carrier with the adhesive, and then pressing the adhesive onto the layer to be bonded. To prevent the adhesive from plugging the pores in the membrane layers, the adhesive is contact printed only onto the patterned surfaces of the channel and separation channel layers. Solvents may be used to modify the viscosity of the adhesive in order to achieve a thickness of at most 2 μm via spincoating and to achieve sharp interfaces between the those areas printed with the adhesive, and those areas without adhesive. Optical microscope inspection after contact printing may be used to monitor the degree to which the pattern is resolved during the printing. The resolution is determined by the smallest dimension that can be printed without bridging and/or seeping of the adhesive into the channel. If a printed layer has errors, the layer surface can be reprinted with adhesive after removing the previous layer with a solvent (for example, methanol). Features of 100 μm can be resolved using an adhesive layer of at most 1 μm thick. Thinner adhesive layers achieve better transfer resolution, but also tend to be harder to release from the temporary adhesive carrier and cannot accommodate local non-uniformities.

The adhesive preferably bonds the layers by covalent bonding, or by being physically keyed into the layer (for example, by the adhesive flowing into a pore having an opening smaller than the interior, prior to curing). Since the layers are held on the carrier plate by non-covalent forces, for example by hydrogen bonding, they can be released from the carrier plate without affecting the adhesive.

The adhesive preferably forms a solid resin, such as a bisphenol-A based resin adhesive. Examples include DER 642U, DER 662, DER 663U, DER 664U, DER 665U, DER 667 and DER 672U, all from Dow Corning. These adhesives use a hardener, such as DEH 82, DEH 84, DEH 85 and DEH 87, all from Dow Corning. The adhesive may also be an epoxy adhesive mixture of solid epoxy novalac-modified resin with curing agent in a 2.5:1 mass ratio. Solvent may be added to the adhesive to control the viscosity, for example 2-methoxyethanol (15 to 50% by mass), anisole (15 to 50% by mass), and PGMEA (0 to 10% by mass) range. The bonding of the layers may be carried out by heating to cure the adhesive, for example at 130° C. and 5.2 MPa of applied pressure under vacuum for 10 minutes. The temporary adhesive carrier is an elastic polymer, such as a 3 mm thick 50 mm diameter PDMS disk; the carrier plate may be released from the layer by using a hot water bath at approximately 50° C. for 5 minutes. The adhesive may be given a final cure, for example by heating the completed device for 12 hours at 130° C.

While wetting of the adhesive and sealing of the pores is essential for preventing delamination, seeping and bridging may also occur and the corners of the channels can become filled if the adhesive over wets a channel layer or the separation channel layer. This problem can also lead to blockage of pores at the junctions, as well as the channels. Seepage of adhesive, and rolled-off edges due to poor etching, may also causes variability in the electroosmotic flow within channels and between different chips. Therefore, achieving the right balance of adhesive wetting and edge resolution is also important for the electrical operation of the device.

A possible problem with membrane layers that are hydrophilic is side channel leakage and subsequent delamination due to capillary forces. If water wicks into small radii pores, the capillary head pressure pulling in the water can be quite high, providing a driving force for seepage of water between the layers, especially if the pores are not fully sealed by the adhesive. If glass or silicon is used instead of a polymer for the substrate, the higher CTE mismatch creates additional stresses, so that simply adding water to the channels, without any applied pressure, may cause spontaneous delamination. By adjusting the viscosity and printing of the adhesive, the adhesive completely seals the pores at the edges to prevent leakage and to sustain high pressures without delamination.

Another factor that affects contact printing resolution is the temperature of the adhesive carrier. PDMS has a greater affinity to the adhesive when it is cold, and the affinity decreases with increasing temperature. Heating the PDMS carrier and adhesive to 50° C. for 3 minutes improves the transfer of the adhesive, and when the PDMS carrier is removed, the chip and adhesive carrier are cooled to improve the adhesion of the adhesive that is not in contact with the surface. This heating and cooling of the adhesive carrier also increases the yield of the process, in addition to significantly improving the contact printing resolution.

Another important issue is maintaining planarity as each layer is added to the stack. With the addition of each layer, the global non-uniformities tend to be additive, making sequential bonding of layers more difficult. Local non-uniformities are mitigated by requiring each added layer to fully cover the previous layer across the chip, and by the adhesive layer being approximately 2 μm thick. For example, convenient chip size is 24×40 mm, because it fits inside a standard membrane size of 47 mm and it approximates the usable dimension of the coated coverglass (35×50 mm) used as the carrier plate, after the areas affected by edge bead are removed (generally 2 to 5 mm per side). Elimination of step-height differences by requiring full layer coverage, and the elimination of individual layer thickness variations greater than 1 μm, enabled the fabrication of a multilayer device, for example having at least 8 layers, such as 8-11 layers. Global non-uniformities are mitigated by using a rigid-compliant assembly.

When bonding multilayered structures, the compliance between the individual layers and their carrier plates determines the overall quality of the bonds between layers. One advantage for using an elastic carrier plate is that the large compliance of a relatively thick (>100 μm) elastomer can accommodate many microns of non-uniform layers. However, the much higher (2 to 3 orders of magnitude) modulus of PMMA and PC materials make these layers much more rigid, so the carrier plate chosen for the PMMA layers was a 0.2 mm thick coverglass because it can bend to match the surface being bonded. During bonding, an elastomeric polymer is used to apply uniform pressure to the back of the carrier plate, so that the PMMA globally conforms to the chip surface. The membrane layers are bonded using a temporary elastic carrier, such as PDMS, so that the membrane can conform to the multilayer stack.

Thermally induced stress, from a mismatch of the coefficient of thermal expansion (CTE) between the layers, can cause the layers to delaminate, either spontaneously or at low applied fluid pressures within the channels. Using an all-polymer chip reduces the thermally induced stresses enough that chips can be fabricated using a contact printable thermally cured adhesive, and the chips can sustain applied fluid pressures above 6 atm. Using these methods and materials, more than 11 layers may be stacked and bonded.

The layer bond strength of the chip may be determined by fabricating modified chips whose reservoirs are tapped to accommodate high pressure hose fittings (such as those from Legris). After filling a channel with fluorescent solution, both ends of the channel are pressurized with nitrogen. The channel is monitored under a microscope during the pressurization process to detect delamination of the layers. Nitrogen pressure is slowly increased until chip failure occurs. If layers do not delaminate, and there is no leakage, the only failure mechanism observed is the rupture of the reservoir bottom. Preferably, the device has a layer bond strength of at least 1 atm (0.1 MPa), more preferably at least 3 atm (0.3 MPa), most preferably at least 6 atm (0.6 MPa), gauge.

EXAMPLE

An 8 layer chip was fabricated using a PC substrate 1.5 mm thick with ten 4 mm diameter reservoirs. The via reduction layer, both channel layers, the separation channel layer, and the cap layer, were formed from PMMA and etched by RIE using an oxygen and argon plasma (Axic RIE—600 Watts). The carrier plates were coverglass (Fisher Scientific, 35×50 mm, #2 thickness). The membranes layers were nanocapillary PC membranes, 6-10 μm thick (GE Osmonics Labstore).

The adhesive was a mixture of 0.30 g 2-methylimidazole (an accelerator), 3.35 g DEH 87 (Dow Corning), 8.35 g DER 672U (Dow Corning), and 28 g anisole (Sigma Aldrich). After 12-24 hours of mixing, two more solvents were added, 20 g 2-methoxyethanol (Sigma Aldrich) and 5 g PGMEA (Sigma Aldrich). The temporary adhesive carrier was a 3 mm thick, 50 mm diameter, PDMS disk (Sylgard 184; Dow Corning).

The pressure that the chip can sustain without failure by rupture or delamination is one important indicator of robustness of the fabrication process and chip operation. The use of PVP-coated nanoporous PC membranes to serve as the NCAM could lead to problems with side channel leakage and subsequent delamination due to hydrophillic capillary forces. The wetting angle, θ, on PVP-coated PC is about 45° or smaller. Thus, with pore radii of 10 to 220 nm, the capillary head pressure pulling in the water can be quite high, if the pores are not fully sealed by the adhesive. Although it is difficult to calculate and/or measure the additional capillary pressure of water at the PMMA/NCAM interface, a simple estimate is $P_{eff}=\pi\gamma_{lv}\cos(\theta)/2\alpha^2 r$, where $\gamma_{lv}$ is the liquid-vapor surface tension of water (0.0728 N/m at 25° C.), α is the average pore spacing to diameter ratio, and r is the radius of the pore. $P_{eff}$ essentially adds a hydrostatic fluid pressure between the layers that ranges for α=4 (which is approximately the case for the membranes used here) from a low of ~0.5 atm for 220 nm pores to nearly 10 atm for 10 nm pores.

The fluidic electrical resistance was measured for the long separation channel and the shorter cross channels. Such measurements verify the integrity of the microfluidic elements, and uncover issues with the adhesives or the processing affecting the membranes between the channels. Electrical characterization was performed on chips containing only a single membrane (220 nm) to avoid convolving effects from multiple membranes on the measurements. The resistance per unit length, R', of a solution across is measured by monitoring the current, i, within the channel at a series of voltage differences, ΔV. The resistance was calculated as an average value from R'=(ΔV/Δl)/i, where Δl is the length of the region. For testing, the channels were filled under vacuum with an electrolyte solution of 10 mM phosphate buffer (PB) in deionized water at a pH of 7.4, with a measured conductivity of $1.124\times10^{-3}$ $\{\Omega\text{-cm}\}^{-1}$ using Thermo Orion Conductivity Meter model 105Aplus. Platinum electrodes (Goodfellow) were inserted into the corresponding solution reservoirs and a voltage difference was applied across each channel. Linear I-V plots ($R^2$>0.995) were obtained and the resistances of the spatially separated channels were calculated. A mean of 26.7+/−0.4 MΩ/cm was obtained for the longer microfluidic channel (Δl=2.80 cm), and 37.6±0.2 MΩ/cm for the shorter cross channels (Δl=1.23 cm). Although R' is an extensive property of the chip and solution, the measured values was comparable to those expected for the 10 mM PB solution with the conductivity noted above, and an average of the electroosmotic flow mobilities in Table 1 ($2.8\times10^{-4}$ $cm^2/V\cdot s$). For 100 μm wide by 20 μm high channels, the expected resistance per unit length is 34.6 MΩ/cm, which is near the average for all the channels of 32.1+/−0.5 MΩ/cm. No measurable leakage current was observed through the chip itself, indicating no discernable fluid leaks between levels and the inherent electrical insulating property of the layers.

The electroosmotic flow (EOF) coefficients given in Table 1 was measured for the same two regions within the chip using the current monitoring method previously described.[15] Briefly, the chip was filled under vacuum with 10 mM PB in deionized water and conditioned for approximately 5 minutes with the application of 50 V across the different regions. Then, for each of the regions tested, one reservoir was loaded with 5 mM PB before applying 100 V across the corresponding channel. The change in current with respect to time was monitored as the 5 mM solution replaces the 10 mM and a current plateau was reached. The average electroosmotic mobilities reported in Table 1 were calculated from three measurements on the same chip. These EOF values are within a factor of two of other published EOF values for all PMMA channels, which are noted to vary with processing techniques as well.[16]

TABLE 1

Electroosmotic coefficients $\{cm^2/Vs\}$ for phosphate buffer solution versus pH measured

| | Separation channel | Average of two cross channels |
|---|---|---|
| pH 4.4 | $2.2 +/- 0.3\times10^{-4}$ | $2.5 +/- 0.9\times10^{-4}$ |
| pH 7.3 | $3.5 +/- 0.7\times10^{-4}$ | $2.8 +/- 0.5\times10^{-4}$ |
| pH 8.8 | $3.3 +/- 0.6\times10^{-4}$ | $2.7 +/- 0.6\times10^{-4}$ |

It is important to note, however, that the channels of this multilayer chip with alternating PMMA and NCAM layers, are not made entirely of the same material. The cross channels at Layer #3 and Layer #7 have PMMA on three sides for a total of 140 μm wetted perimeter, and 100 μm wetted perimeter for the PC NCAM. Conversely, the separation channel has 40 μm and 200 μm wetted perimeters for the PMMA and PC NCAMs, respectively. If the walls had large differences in EOF mobility, an even larger differences in the average EOF coefficients measured would have been seen, since the difference in wetted perimeters between the two cases is 350% for the PMMA and 200% for the PC NCAM. The observed differences, however, are less than 25% for all cases, which is nearly within the uncertainty for the channels. Finally, the effect on the EOF of adhesive at the corners appears to be at most 36% given by the uncertainty; channels with significant corner beads of adhesive experienced significantly larger variability between chips (much greater than 100%).

In order to demonstrate the transport of fluid across the NCAM and between the spatially separated microchannels, experiments were performed using laser-induced fluorescence (LIF) detection. The chip was filled under vacuum with the same 10 mM phosphate buffer solution, while only one of the shorter cross channels contained an addition of 1 μM of green-fluorescent protein (GFP). A 488 nm $Ar^+$ laser was focused by a 10× objective of a microscope to a spot in the longer, receiving channel immediately following the NCAM interconnect. An electric bias was applied to facilitate transport of the GFP through the NCAM, and into the receiving channel.

The resulting fluorescence light was collected with a photomultiplier tube (Hamamatsu) as part of the LIF experimental setup. The plug injections were confined and reproducible, and resulted in symmetrical peaks and an 9.6% RSD of the integrated peak areas. The chips described here have the same or better efficacy for injection as the PDMS/PC NCAM devices previously reported.[4]

REFERENCES

1 R. H. Liu, K. V. Sharp, M. G. Olsen, M. A. Stremler, J. G. Santiago, R. J. Adrian, H. Aref, and D. J. Beebe, *Proc. Transducers '99*, Sendai, Japan, 730; B. L. Grey, D. Jaeggi, N. J. Mourlas, B. P. Drieenhuizen, K. R. Williams, N. I. Maluf, and G. T. A. Kovacs, *Sensor Actuat.* 1999, 77, 57; S. M. Kugelmass, C. Lin, and S. H. DeWitt, *Proc of SPIE,* 1999, 3877, 88; B. H. Jo, L. M. Van Lerberghe, K. M. Motsegood, and D. J. Beebe, *J. Microelectromech. S.,* 2000, 9, 76; J. R. Anderson, D. T. Chiu, R. J. Jackman, O. Cherniavskaya, J. C. McDonald, H. Wu, S. H. Witesides, and G. M Whitesides, *Anal. Chem.* 2000, 72, 3158; B. H. Weigl, R. Bardell, T. Schulte, R. Battrell, and J. Hayenga, *Biomedical Microdevices,* 2001, 3, 267; J. C. McDonald, M. L. Chabinyc, S. J. Metallo, J. R. Anderson, A. D. Stroock, and G. M Whitesides, *Anal. Chem.* 2002, 74, 1537; T. Thorsen, S. J. Maerkl, and S. R. Quake, *Science,* 2002, 298 (5593), 580; M. Agirregabiria, F. J. Blanco, J. Berganzo, M. T. Arroyo, A. Fullaondo, K. Mayora and J. M. Ruano-Lopez, *Lab Chip,* 2005, 5, 545; D. Mijatovic, J. C. T. Eijkel, and A. van den Berg, *Lab Chip,* 2005, 5, 492.

2 A. N. Chatterjee, D. M. Cannon, Jr., E. N. Gatimu, J. V. Sweedler, N. R. Aluru, and P. W. Bohn, *J. Nanopart. Res.* 2005, 7, 507-516; A. Yaroshchuk, O. Zhukova, M. Ulbricht, and V. Ribitsch, *Langmuir,* 2005, 21, 6872; A. Plecis, R. B. Schoh, and P. Renaud, *Nano Lett.* 2005, 5,1147; R. Karnik, R. Fan, M. Yue, D. Li, P. Yang, and A. Majumdar, *Nano Lett.* 2005, 5, 943; T. C. Kuo, L. A. Sloan, J. V. Sweedler, and P. W. Bohn, *Langmuir,* 2001, 17, 6298; Patent Application Publication, publication no. US2003/0136679 (24 Jul. 2003).

3 T. C. Kuo, D. M. Cannon, Jr., M. A. Shannon, P. W. Bohn, and J. V. Sweedler, *Sens. Actuators A,* 2003,102, 223.

4 D. M. Cannon, Jr., T. C. Kuo, P. W. Bohn, and J. V. Sweedler, *Anal. Chem.* 2003, 75, 2224.

5 T. C. Kuo, H. K. Kim, D. M. Cannon, Jr., M. A. Shannon, J. V. Sweedler, and P. W. Bohn, *Angew. Chem. Int. Ed.* 2004, 43,1862.

6 J. J. Tulock, M. A. Shannon, P. W. Bohn, and J. V. Sweedler, *Anal. Chem.* 2004, 76, 6419.

7 T. C. Kuo, D. M. Cannon, Jr., Y. Chen, J. J. Tulock, M. A. Shannon, J. V. Sweedler, and P. W. Bohn, *Anal. Chem.* 2003, 75, 1861.

8 J. C. Selby, M. A. Shannon, K. Xu, and J. Economy, *J. Micromech. Microeng.* 2001, 11 (6),672.

9 L. H. Dubois and R. G. Nuzzo, *Annu. Rev. Phys. Chem.* 1992, 43, 437; A. Kumar and G. M. Whitesides, *Appl. Phys. Lett.* 1993, 63, 2002

10 Y. L. Loo, R. L. Willett, K. W. Baldwin, and J. A. Rogers, *Appl. Phys. Lett.* 2002, 81, 562; H. Schmid, H. Wolf, H. Riel, S. Karg, B. Michel, and E. Delamarche, *Adv. Funct. Mater.* 2003, 13, 145.

11 M. Wang, H. G. Braun, T. Kratzmüller, and E. Meyer, *Adv. Mater.* 2001, 13, 1312.

12 J. Oberhammer and G. Stemme, *J. Microelectromech. S.* 2005, 14, 419.

13 Y. Xia and G. M. Whitesides, *Angew. Chem. Int. Ed.* 1998, 37, 550.

14 Z. Huang, J. C. Sanders, C. Dunsmor, H. Ahmadzadeh, and J. P. Landers, *Electrophoresis,* 2001, 22, 3924.

15 X. Huang, M. J. Gordon, and R. N Zare, *Anal. Chem.* 1988, 60, 1837.16 Z. Chen, Y. Gao, R. Su, C. Li, and J. Lin, *Electrophoresis,* 2003, 24, 3246.

17 B. J. Kirby and E. F. Hasselbrink Jr., *Electrophoresis,* 2004, 25, 203.

What is claimed is:

1. A method of bonding layers to form a structure, comprising:

curing a first adhesive while squeezing a first layer and a multilayer structure together between a first backing and a second backing;

wherein the multilayer structure comprises a substrate and a second layer, the first adhesive is between and in contact with the first layer and the second layer, the first layer and the second layer each have a thickness of at most 100 μm, and at least one of the first backing and the second backing comprises a first elastic polymer.

2. The method of claim 1, wherein the first layer is on a carrier plate.

3. The method of claim 2, further comprising, after the curing, releasing the carrier plate from the first layer.

4. The method of claim 3, wherein the releasing comprises contacting the carrier plate and the first layer with water.

5. The method of claim 1, wherein the first adhesive has a thickness of at most 2 μm.

6. The method of claim 5, further comprising contact printing the first adhesive on at least one of the first layer and the second layer.

7. The method of claim 6, wherein the first adhesive is on a carrier comprising a second elastic polymer, prior to the contact printing.

8. The method of claim 7, wherein the second elastic polymer is poly(dimethylsiloxane).

9. The method of claim 6, further comprising etching a channel in at least one of the first layer and the second layer;

wherein the first adhesive is contact printed on the first or second layer having the channel.

10. The method of claim 3, wherein the first adhesive has a thickness of at most 2 μm.

11. The method of claim 10, further comprising contact printing the first adhesive on at least one of the first layer and the second layer.

12. The method of claim 11, wherein the first adhesive is on a carrier comprising a second elastic polymer, prior to the contact printing.

13. The method of claim 1, wherein the first layer and the second layer each have a thickness of 5-60 μm.

14. The method of claim 1, wherein the first elastic polymer is poly(dimethylsiloxane).

15. The method of claim 1, further comprising etching a channel in at least one of the first layer and the second layer.

16. The method of claim 1, wherein during the squeezing, the first layer is between the second layer and a third layer, a second adhesive is between and in contact with the first layer and the third layer, and the third layer has a thickness of at most 100 μm.

17. The method of claim 16, further comprising, before the curing, etching a channel in the second layer and etching a channel in the third layer.

18. The method of claim 16, wherein the first layer has pores having an average diameter of 10-400 nm.

19. A method of forming a multilayer device, comprising:

curing a first adhesive and a second adhesive while squeezing a first layer between a third layer and a multilayer structure; and curing a third adhesive and a fourth adhesive while squeezing a fourth layer between the third layer and a fifth layer;

wherein the multilayer structure comprises a substrate and a second layer, the squeezing of the first layer comprises squeezing the first layer, the second layer and the third layer between a first backing and a second backing, the squeezing of the fourth layer comprises squeezing the third layer, the fourth layer and the fifth layer between a third backing and a fourth backing, the first adhesive is between and in contact with the first layer and the second layer, the second adhesive is between and in contact with the first layer and the third layer, the third adhesive is between and in contact with the fourth layer and the third layer, the fourth adhesive is between and in contact with the fourth layer and the fifth layer, each adhesive has a thickness of at most 2 μm, each layer has a thickness of at most 100 μm, at least one of the first backing and the second backing comprises a first elastic polymer, and at least one of the third backing and the fourth backing comprises a third elastic polymer.

20. The method of claim 19, wherein the first layer and the fourth layer each have pores having an average diameter of 10-400 nm.

21. The method of claim 19, further comprising etching a channel by reactive ion etching in each of the second layer, the third layer and the fifth layer.

22. A multilayer device, comprising:

a substrate layer, a first channel layer having a channel, on the substrate, a first membrane layer having pores with an average diameter of 1 nm to 1 μm, on the first channel layer, a second channel layer having a channel, on the first membrane layer, a second membrane layer having pores with an average diameter of 1 nm to 1 μm, on the second channel layer, a third channel layer having a channel, on the second membrane layer, a cap layer, on the third channel layer, and cured adhesive between adjacent layers, having a thickness of at most 2 μm, wherein each channel layer and each membrane layer has a thickness of at most 100 μm, and the device has a layer bond strength of at least 0.1 MPa.

23. The device of claim 22, having a layer bond strength of at least 0.6 MPa.

24. The device of claim 22, wherein the pores in the membrane layers have an average diameter of 10-400 nm.

25. The device of claim 22, further comprising:

a third membrane layer having pores with an average diameter of 1 nm to 1 μm, on the third channel layer, and a fourth channel layer having a channel, on the third membrane layer, wherein the cap layer is on the fourth channel layer.

26. The device of claim 22, comprising at least 8 layers.

27. The device of claim 22, comprising 8-11 layers.

28. The device of claim 22, wherein each layer comprises a polymer.

* * * * *